United States Patent [19]

Ikeda et al.

[11] Patent Number: 4,767,283

[45] Date of Patent: Aug. 30, 1988

[54] SWASH PLATE TYPE COMPRESSOR

[75] Inventors: Hayato Ikeda; Hiroshi Onomura; Satoshi Kitahama, all of Kariya, Japan

[73] Assignee: Kabushiki Kaisha Toyoda Jidoshokki Seisakusho, Aichi, Japan

[21] Appl. No.: 78,417

[22] Filed: Jul. 27, 1987

[30] Foreign Application Priority Data

Jul. 28, 1986 [JP] Japan ..... 61-177415

[51] Int. Cl.[4] ..... F04B 1/16; F04B 1/18; F01M 1/04

[52] U.S. Cl. ..... 417/269; 184/6.17; 92/71

[58] Field of Search ..... 417/269; 184/6.17; 92/71

[56] References Cited

U.S. PATENT DOCUMENTS 4,101,250 7/1978 Nakayama ..... 417/269
4,408,962 10/1983 Nakayama ..... 417/269
4,534,710 8/1985 Higuchi et al. ..... 417/269
4,586,876 5/1986 Kato ..... 417/269

FOREIGN PATENT DOCUMENTS 56-23583 3/1981 Japan .

*Primary Examiner*—William L. Freeh
*Attorney, Agent, or Firm*—Burgess, Ryan & Wayne

[57] ABSTRACT

A swash plate type compressor having a plurality of double-headed pistons reciprocating in axially extending cylinder bores of a cylinder block unit for compressing refrigerant gas, in which refrigerant gas returning from a refrigerating circuit is initially introduced into a swash plate chamber enclosed by a pair of axially opposed planar walls and a substantially cylindrical wall of the cylinder block unit, and is circularly flown along a pair of circular refrigerant passageways formed in both planar walls of the swash plate chamber before being drawn into the cylinder bores so that a circularly flowing refrigerant gas lubricates moving elements, such as shoes and radial and thrust bearings, of the compressor.

5 Claims, 4 Drawing Sheets

SWASH PLATE TYPE COMPRESSOR

BACKGROUND OF THE INVENTION

1. Field of the Invention

The present invention relates generally to a swash plate type compressor having double-headed reciprocating pistons driven by a swash plate and adapted for use in automobile air-conditioning systems. More particularly, it relates to an improved internal lubricating system of the described type of swash plate type compressor.

2. Description of the Related Art

The U.S. Pat. No. 4,534,710 to Higuchi et al discloses a typical swash plate type compressor in which refrigerant gas is compressed by reciprocation of a plurality of double-headed pistons driven, via shoe elements, by a swash plate rotating with a drive shaft within a swash plate chamber centrally arranged in a pair of axially combined front and rear cylinder blocks. The swash plate chamber is enclosed by a pair of planar walls extending vertically to the axis of the drive shaft and axially spaced one another, and a substantially cylindrical wall extending between the pair of planar walls. The refrigerant gas returning from the air-conditioning system is initially drawn, via suction ports of the cylinder blocks and suction openings formed in the cylindrical wall of the swash plate chamber into the chamber. The refrigerant gas is then passed through suction passageways communicated with the swash plate chamber until the gas reaches suction chambers formed in front and rear housings attached to the front and rear ends of the combined cylinder blocks. The refrigerant gas in the suction chambers is then sucked into the cylinder bores and is compressed by the pistons. The compressed refrigerant gas is discharged from the cylinder bores into the discharge chambers formed in the front and rear housings, and is further sent toward the outside refrigerating circuit. However, when the refrigerant gas is drawn into the swash plate chamber during rotation of the swash plate, a major part of the refrigerant gas within the swash plate chamber is forced to flow in a circular manner along the cylindrical wall of the swash plate chamber by the effect of centrifugal force thereon as well as the thrust provided by the rotating swash plate, and is drawn into the suction passageways by the reciprocation of the pistons, and as a result, sufficient refrigerant gas is not supplied to a central region of the swash plate chamber. Therefore, a lack of lubrication of the moving elements, such as shoe elements, and radial and thrust bearings rotatably supporting the drive shaft and the swash plate, occurs. Accordingly, the operation life of the moving elements is necessarily shortened, thus decreasing the operational life of the swash plate type compressor per se.

SUMMARY OF THE INVENTION

An object of the present invention is therefore to obviate the above-mentioned drawbacks encountered by the conventional swash plate type compressor.

Another object of the present invention is to provide an improvement to a swash plate type compressor by which the internal moving elements of the compressor are lubricated by the refrigerant gas introduced into the swash plate chamber.

A further object of the present invention is to provide a lubricating mechanism in the swash plate chamber of a swash plate type compressor having a plurality of double-headed reciprocating pistons for compressing the refrigerant gas.

In accordance with the present invention, there is provided a swash plate type compressor comprising:

a pair of front and rear cylinder blocks axially combined together to form an axially extending cylinder block unit having at least one suction port for refrigerant gas to be compressed;

a pair of front and rear housings closing front and rear ends of the cylinder block unit, the front and rear housings having formed therein a suction chamber for refrigerant gas before compression and a discharge chamber for refrigerant gas after compression, respectively;

a plurality of axially extending cylinder bores formed in the cylinder block unit in parallel with one another, the cylinder bores being circumferentially equiangularly arranged so that respective centers of the plurality of cylinder bores are located on a predetermined circle defined about a center of the cylinder block unit;

a swash plate chamber formed in the cylinder block unit at an axially central position thereof whereat the pair of front and rear cylinder blocks are joined together, the swash plate chamber having a pair of axially opposed planar walls, a circumferentially extending cylindrical wall, and at least one opening in fluid communication with the suction port so as to introduce the refrigerant gas before compression from the suction port into the swash plate chamber;

a plurality of suction passageways formed in the cylinder block unit for permitting the refrigerant gas before compression to flow from the swash plate chamber toward the suction chambers of the front and rear housings;

a drive shaft rotatably supported, via radial ball bearings, in the cylinder block unit;

a circular swash plate rotatably arranged in the swash plate chamber, and having a central boss portion by which the swash plate is fixedly mounted on the drive shaft so as to rotate with the drive shaft;

thrust bearings arranged between the boss portion of the swash plate and the front and rear cylinder blocks;

a plurality of pistons slidably fitted in the plurality of cylinder bores, the pistons reciprocating within the plurality of cylinder bores for drawing the refrigerant gas before compression from the suction chambers into the cylinder bores, compressing the refrigerant gas within the cylinder bores, and discharging the refrigerant gas after compression toward the discharge chambers, each of the pistons having a radial recess opening inwardly toward the swash plate chamber;

shoes arranged in the radial recess of each of the plurality of the pistons in engagement with the swash plate for causing a reciprocatory movement of each of the plurality of pistons in response to rotation of the swash plate;

circular refrigerant passageway means formed in the pair of axially opposed planar walls of the swash plate chamber for permitting the refrigerant gas within the swash plate chamber to flow circularly in the refrigerant passageway means along the predetermined circle defined about a center of the cylinder block unit during rotation of the swash plate, and;

blocking means for preventing the refrigerant gas within the swash plate chamber from flowing on the circumferentially extending cylindrical wall of the swash plate chamber during rotation of the swash plate.

DESCRIPTION OF THE DRAWINGS

The above and other objects, features and advantages of the present invention will be made more apparent from the ensuing description of the preferred embodiment of the present invention with reference to the accompanying drawings, wherein.

DESCRIPTION OF THE PREFERRED EMBODIMENTS

Figure 1:
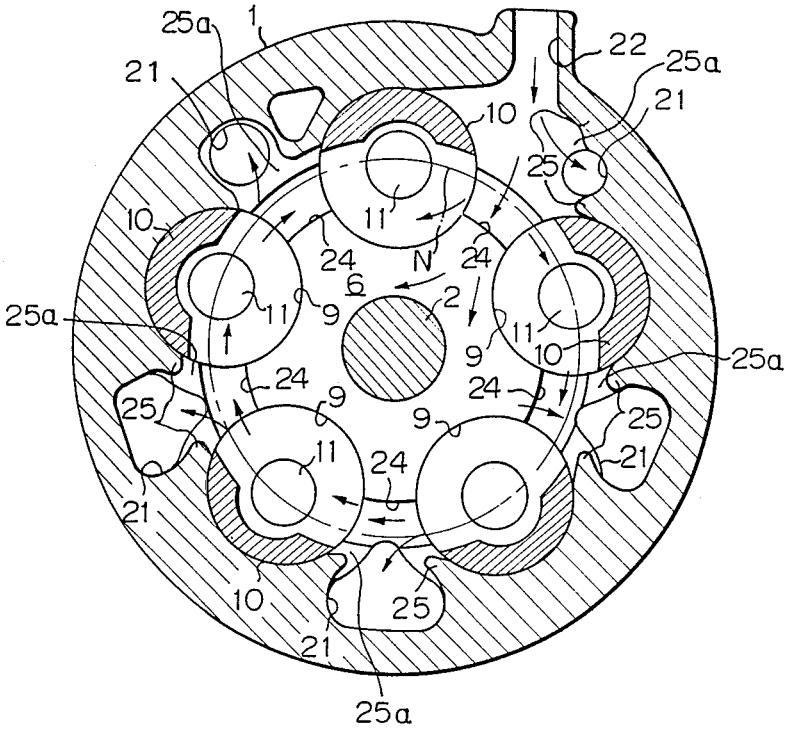
FIG. 1 is a vertical cross-sectional view of a portion of the swash plate chamber of a swash plate type compressor, according to an embodiment of the present invention.
Figure 4:
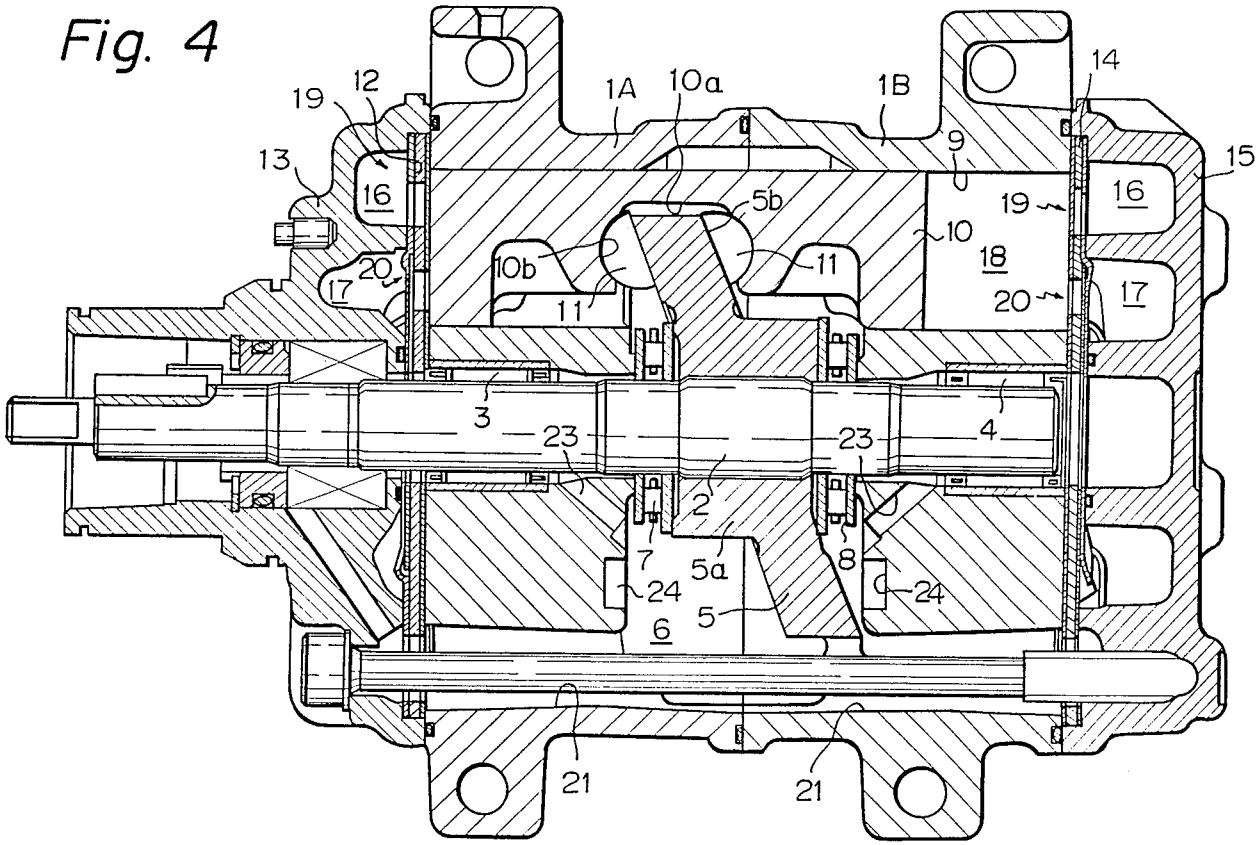
FIG. 4 is a longitudinal cross-sectional view of the swash plate type compressor according to the embodiment of the present invention, illustrating the general construction of the compressor.

Referring first to FIG. 4, a swash plate type compressor according to the present invention has a pair of axially aligned front and rear cylinder blocks 1A and 1B forming a tightly combined cylinder block unit in which an axially extending drive shaft 2 is rotatably supported by means of front and rear radial ball bearings 3 and 4. The compressor also has a swash plate 5 fixedly mounted, at a boss portion thereof, on the drive shaft 2 so as to be rotated together with the drive shaft 2. The swash plate 5 is located in a swash plate chamber 6 which is formed in the combined cylinder unit as a substantially cylindrical chamber enclosed by a pair of axially opposed planar walls 6*a* and a cylindrical wall 6*c* (FIG. 2), and is located at the joint of the front and rear cylinder blocks 1A and 1B. The swash plate 5 is axially supported by thrust bearings 7 and 8 arranged between the front and rear ends of the boss portion 5A of the swash plate 5 and inner ends of the front and rear cylinder blocks 1A and 1B. The cylinder block unit has formed therein a plurality of axially extending cylinder bores 9 (five cylinder bores 9 in the present embodiment) equiangularly arranged around the center of the cylinder block unit. At this stage, the centers of the respective cylinder bores 9 are disposed on a common circle N defined about the center of the cylinder block unit, as best shown in FIG. 1. The diameter of the circle N is determined during the design of the compressor per se. A plurality of double-headed pistons 10 are slidably fitted in the cylinder bores 9. Each of the pistons 10 has a radial recess 10*a* formed at an axially middle portion thereof so as to open inwardly toward the central axis of the cylinder block unit. The radial recess 10*a* of each piston 10 permits the swash plate 5 to pass therethrough when rotating with the drive shaft 2. The swash plate 5 is engaged with a pair of semi-spherical shoes 11 received in axially opposed spherical bores 10*b* formed in the radial recess 10*a* of the piston 10. Thus, when the swash plate 5 rotat-es about the central axis thereof within the swash plate chamber 6, each of the plurality of double-headed pistons 10 reciprocates in the corresponding cylinder bore 9 in the axially front and rear directions with respect to a middle position of the piston 10 where the center of the radial recess 10*a* of the piston 10 comes to an axially central position of the swash plate chamber 6. The reciprocation of the double-headed pistons 10 within the respective cylinder bores 9 causes the later-described drawing of refrigerant gas into the cylinder bores 9, compression of the refrigerant gas, and delivery of the compressed refrigerant gas from the cylinder bores 9.

A front housing 13 is connected to the front end of the front cylinder block 1A, via a front valve plate 12, and a rear housing 15 is connected to the rear end of the rear cylinder block 1B, via a rear valve plate 14. The front and rear housing 13 and 15 have formed therein an outer annular suction chamber 16 and an inner discharge chamber 17, respectively. The front and rear valve plates 12 and 14 have respectively a suction valve mechanism 19 for communicating compression chambers 18 of the respective cylinder bores 9 with the suction chambers 16 of the front and rear housings 13 and 15, and a delivery valve mechanism 20 for communicating the compression chambers 18 with the discharge chambers 17 of the front and rear housings. The suction chambers 16 of the front and rear housings 13 and 15 are commonly communicated with the above-mentioned swash plate chamber 6 by a plurality of suction passageways 21 (five suction passageways 21 in the case of the present embodiment) which are axially bored through an outer region of the cylinder block unit in such a manner that each of the suction passageways 21 is located between the two neighbouring cylinder bores 9. The front and rear cylinder blocks 1A and 1B of the cylinder block unit have formed therein a pair of suction ports 22 located at the joint of the two cylinder blocks 1A and 1B for introducing the refrigerant gas from the outside refrigerating circuit into the swash plate chamber 6. That is, the swash plate chamber 6 has formed in the cylindrical wall 6*c* thereof, openings 6*d* in fluid communication with the suction ports 22, so that the refrigerant gas containing therein a lubricating oil mist is drawn under a suction pressure into the center of the swash plate chamber 6. The swash plate chamber 6 is communicated with the radial ball bearings 3 and 4 by passageways 23 extending from the planar walls 6*a* of the swash plate chamber 6 toward the bearing bore of the cylinder block unit.

Figure 2:
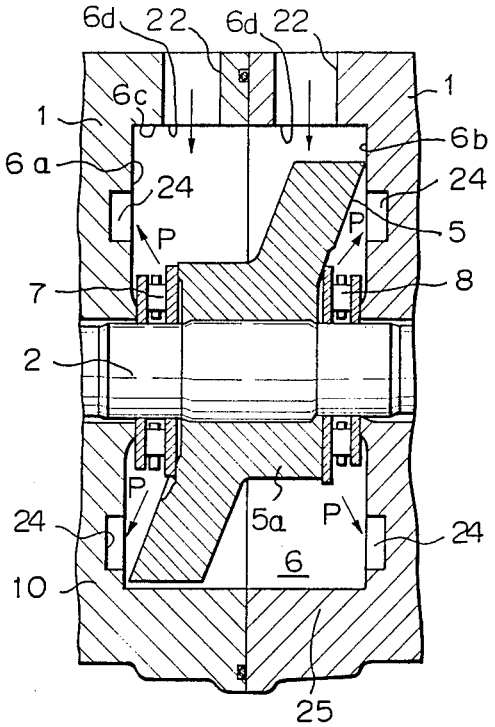
FIG. 2 is a partial axial cross-sectional view of the swash plate type compressor of FIG. 1, illustrating the internal construction of the swash plate chamber.

As shown in FIGS. 1 and 2, refrigerant passageways 24 are formed in each of the pair of planar walls 6*a* of the swash plate chamber 6. Each passageway 24 in either one of the two planar walls 6*a* is provided as an arc-shape recess extending between the two neighbouring cylinder bores 9. The cross-section of each refrigerant passageway 24 is rectangular, as understood from the cross-sectional view of FIG. 2, in the case of the present embodiment. This rectangular shape is adopted from the view point of easy machining at the stage of manufacturing the front and rear cylinder blocks 1A and 1B. However, other cross-sectional configurations, for example, a semi-circular shaped cross-section, may be adopted.

Figure 3:
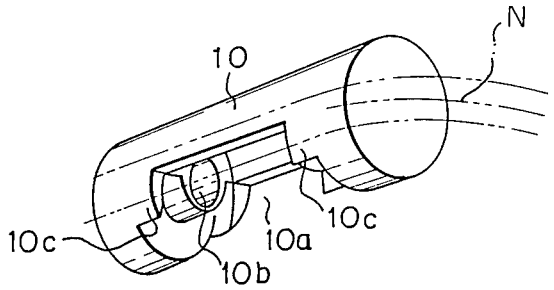
FIG. 3 is a perspective view of a double-headed piston incorporated into the swash plate type compressor of FIG. 1.

The plurality of refrigerant passageways 24 in each planar wall 6a of the swash plate chamber 6 define one circular refrigerant passageway along the afore-mentioned circle N of the cylinder bores 9, as best illustrated in FIG. 1. The circular refrigerant passageway is arranged so as to pass through radially inward portions of the respective cylinder bores 9, the radial width of the circular refrigerant passageway is less than the diameter of the cylinder bore 9. The above-mentioned radial width of the respective circular refrigerant passageways is chosen because, when the radial width of the circular refrigerant passageway is radially inwardly increased, a portion of each of the front and rear cylinder blocks 1A and 1B, which supports a portion 10c of each piston 10 (FIG. 3), provided as a reinforcing extension to protect the piston from being bent by a high pressure applied to the piston end in the compression chamber 18 of the cylinder bore 9, must be cut and removed. On the other hand, when the radial width of the circular refrigerant passageway is radially outwardly increased, another portion of each of the front and rear cylinder blocks 1A and 1B, which guides the heads of each piston 10, must be cut and removed. Therefore, in order to provide a rigid support and stable guide for the reciprocatory sliding pistons 10, the radial width of the respective circular refrigerant passageways defined by the plurality of arc-shaped refrigerant passageways 24 is made less than the diameter of the cylinder bores 9. The axial width and depth of the radial recesses 10a of respective pistons 10 are preselected so that, during the reciprocating movement of respective pistons 10, the circular refrigerant passageways in each of the planar wall 6a of the swash plate chamber 6 are not blocked by the pistons 10. In the illustrated embodiment, the diameter of each cylinder bore 9 is approximately 27 millimeters, the radial width of the refrigerant passageway 24 is approximately 10 millimeters, and the depth of the refrigerant passageway 24 is approximately 5 millimeters. The above-described circular refrigerant passageways in the planar walls 6a of the swash plate chamber 6 are provided to cause the later-described circular flow of the oil-contained refrigerant gas about the central axis of the swash plate 6 and along each planar wall 6a of the swash plate chamber 6.

As illustrated in FIGS. 1 and 2 the cylindrical wall 6c of the swash plate chamber 6 is formed as a cylindrical inner face of radial extensions 25 of the front and rear cylinder blocks 1A and 1B. The extensions 25 are provided so that the cylindrical wall 6c is located adjacent to a locus described by the outermost circumference of the circular swash plate 5 when the swash plate 5 rotates within the swash plate chamber 6. Further, the extensions 25 define an entrance opening 25a for permitting the flow of the refrigerant gas in the refrigerant passageways 24 to enter the respective suction passageways 21. That is, the provision of the extensions 25 prevents the formation of a sufficient spacing between the cylindrical wall 6c and the outer circumference of the swash plate 5 during rotating thereof, and thus a free flow of the refrigerant gas within the swash plate chamber 6 is prevented along the cylindrical wall 6c of the swash plate chamber 6. The operation of the swash plate type compressor of FIGS. 1 through 4 is described hereinbelow.

When the drive shaft 2 is rotated by an outside drive source, such as an automobile engine, the swash plate 5 is also rotated together therewith in the swash plate chamber 6. As a result, the double-headed pistons 10 are reciprocated in the cylinder bores 9, to draw, compress and discharge the refrigerant gas. During the reciprocation of the pistons, the refrigerant gas returning from the outside air-conditioning circuit is introduced into the swash plate chamber 6 as an inertial flow of the refrigerant gas containing therein a lubricating oil mist, via suction ports 22 of the cylinder block unit and the openings of the cylindrical wall 6c of the swash plate chamber 6. Within the swash plate chamber 6, the refrigerant gas first flows toward the center of the swash plate chamber 6. Subsequently, the flow of the refrigerant gas is subjected to a thrust force, a centrifugal force, and a circulating force by the rotating swash plate 5 within the swash plate chamber 6. However, during rotation of the swash plate 5, the outer circumference of the swash plate 5 passes through the radial recesses 10a of respective reciprocating pistons 10 while leaving a small gap between the bottom of the recesses 10a and the outer circumference of the swash plate 5 as well as between the cylindrical wall 6c of the swash plate chamber 6 and the outer circumference of the swash plate 5. Therefore, the refrigerant gas is prevented from flowing along the cylindrical wall 6c of the swash plate chamber 6. Accordingly, the refrigerant gas is first forced to flow toward the refrigerant passageways 24 as shown by arrows P of FIG. 2, and then to circularly flow in the refrigerant passageways 24 in both planar walls 6a of the swash plate chamber 6. The refrigerant gas circularly flowing in the refrigerant passageways 24 lubricates the semi-spherical shoes 11, the surface of the swash plate 5, and the thrust bearings 7 and 8. Also, a part of the circulating flow of the refrigerant gas reaches and lubricates the radial ball bearings 3 and 4, via the passageways 23. The refrigerant gas is finally sucked into the suction passageways 21 and flows to the suction chamber 16 of the front and rear housings 13 and 15. Thereafter, the refrigerant gas is drawn into the respective cylinder bores 9 and is compressed by the double-headed pistons 10.

Figure 5:
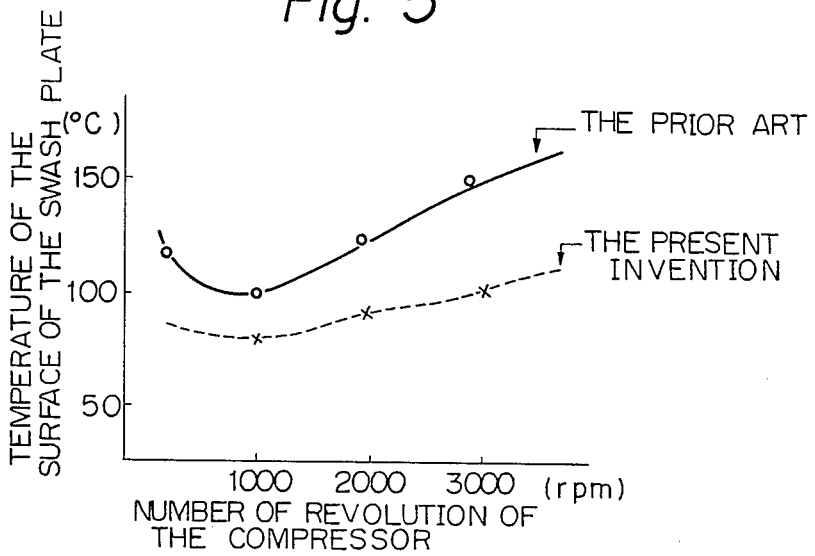
FIG. 5 is a graph illustrating an advantageous result of the present invention, compared with the prior art; and, FIG. 6 is a graph illustrating another advantageous effect of the present invention, compared with the prior art.

FIG. 5 illustrates an advantageous effect of the present invention compared with the prior art. The abscissa of the graph of FIG. 5 indicates the number of revolutions of the compressor, i.e., the number of revolutions of the swash plate, and the ordinate of FIG. 5 indicates a change in the temperature of the surface of the swash plate measured by an appropriate thermometer during the experiment conducted by the present inventors. The dotted line indicates the present invention, and the solid line indicates the prior art.

From the illustration of FIG. 5, it will be understood that a temperature reduction of 20 through 50 degrees centigrade is achieved by the present invention with regard to the surface of the swash plate 5. It was further experimentarily confirmed that, with regard to the compressor of the present invention, the temperature of the thrust bearings 7 and 8, the radial ball bearings 3 and 4, and the contacting faces between the shoes 11 and the sockets 10b of the pistons can be also decreased by the lubricating effect of the lubricating mechanism of the present invention.

Figure 6:
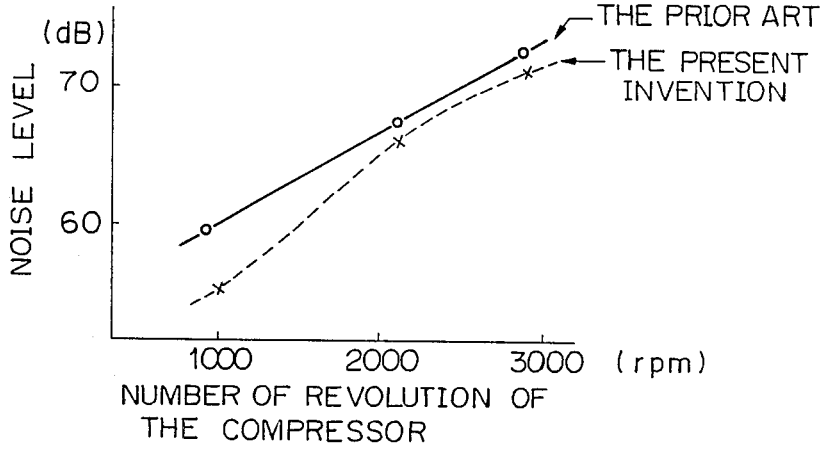

FIG. 6 illustrates the other advantageous effect (noise reduction effect) of the present invention compared with prior art. The abscissa of the graph of FIG. 6 indicates the number of revolutions of the compressor, i.e., the number of revolutions of the swash plate 5 (r.p.m.), and the ordinate of FIG. 6 indicates a change in the measured noise level. The dotted line indicates the present invention, and the solid line indicates the prior art.

From the illustration of the graph of FIG. 6, it will be readily understood that, according to the present invention, the noise level of the running compressor of the present invention is lower than that of the compressor of the prior art. That is, according to the present invention, the operation of the swash plate type compressor is quieter than that of the compressor of the prior art. This means that the operation life of the compressor of the present invention can be increased compared with the prior art.

From the foregoing description of the preferred embodiment of the present invention, the swash plate type compressor according to the present invention is provided with an internal lubricating mechanism capable of prolonging the operational life of the compressor, compared with the swash plate type compressor of the prior art. It should be understood that variations and modifications will occur to a person skilled in the art without departing from the scope and spirit of the present invention claimed in the appended claims.

We claim:

1. A swash plate type compressor comprises:

a pair of front and rear cylinder blocks axially combined together to form an axially extending cylinder block means having at least one suction port for refrigerant to be compressed;

a pair of front and rear housings closing front and rear ends of said cylinder block means, said front and rear housings having formed therein a suction chamber for refrigerant gas before compression and a discharge chamber for refrigerant gas after compression, respectively;

a plurality of axially extending cylinder bores formed in said cylinder block means in parallel with one another, said cylinder bores being circumferentially equiangularly arranged so that respective centers of said plurality of cylinder bores are located on a predetermined circle defined about a center of said cylinder block means;

a swash plate chamber formed in said cylinder block means at an axially central position thereof whereat said pair of front and rear cylinder blocks are joined together, said swash plate chamber having a pair of axially opposed planar walls, a circumferentially extending cylindrical wall, and at least one opening in fluid communication with said suction port so as to introduce the refrigerant gas before compression from said suction port into said swash plate chamber;

a plurality of suction passageways formed in said cylinder block means for permitting the refrigerant gas before compression to flow from said swash plate chamber toward said suction chambers of said front and rear housings;

a drive shaft rotatably supported, via radial ball bearings, in said cylinder block means;

a circular swash plate rotatably arranged in said swash plate chamber, and having a central boss portion by which said swash plate is fixedly mounted on said drive shaft so as to rotate with said drive shaft;

thrust bearings arranged between said boss portion of said swash plate and said front and rear cylinder blocks;

a plurality of pistons slidably fitted in said plurality of cylinder bores, said pistons reciprocating within said plurality of cylinder bores for drawing the refrigerant gas before compression from said suction chambers into said cylinder bores, compressing the refrigerant gas within said cylinder bores, and discharging the refrigerant gas within said cylinder bores, and discharging the refrigerant gas after compression toward said discharge chambers, each of said pistons having a radial recess opening inwardly toward said swash plate chamber;

shoes arranged in said radial recess of said each of said plurality of said pistons in engagement with said swash plate for causing a reciprocatory movement of each of said plurality of pistons in respons to rotation of said swash plate;

circular refrigerant passageway means formed in said pair of axially opposed planar walls of said swash plate chamber for permitting the refrigerant within said swash plate chamber to flow circularly in said refrigerant passageway means along said predetermined circle defined about a center of said cylinder block means during rotation of said swas plate, said circular refrigerant passageway means including a plurality of arc-shaped recesses formed in said each of said pair of axially opposed planar walls of said swash plate chamber, and arranged along said predetermined circle defined about the center of said cylinder block means, each of said arc-shaped recesses being disposed between two neighboring cylinder bores of said plurality of cylinder bores; and, blocking means for preventing the refrigerant within said swash plate chamber from flowing on said circumferentially extending cylindrical wall of said swash plate chamber during rotation of said swash plate.

2. A swash plate type compressor according to claim 1, wherein said blocking means comprise a radial extension from said circumferentially extending cylindrical wall of said swash plate chamber toward a circumference of said circular swash plate, said radial extension defining entrance ports for permitting the refrigerant to enter into said suction passageways from said refrigerant passageway means of said swash plate chamber during rotation of said swash plate.

3. A swash plate type compressor according to claim 1, wherein each said arc-shaped recess of said refrigerant passageway means has a radial width less than a diameter of each of said plurality of cylinder bores.

4. A swash plate type compressor according to claim 1, wherein said arc-shaped recesses formed in both of said pair of axially opposed planar walls of said swash plate chamber are coaxial with one another, whereby two circular flows of the refrigerant gas are formed within said swash plate chamber so as to be disposed adjacent to each of said pair of axially opposed planar walls of said swash plate chamber, said two circular flows of the refrigerant gas within said swash plate chamber lubricating said shoes and said thrust bearings.

5. A swash plate type compressor according to claim 4, wherein said front and rear cylinder blocks have through-holes extending from said pair of axially opposed planar walls of said swash plate chamber toward said radial ball bearings, thereby permitting a part of the circularly flowing refrigerant gas to flow toward said radial ball bearings.

* * * * *